US009027520B2

(12) United States Patent
Gunnel et al.

(10) Patent No.: US 9,027,520 B2
(45) Date of Patent: May 12, 2015

(54) CONSTRUCTED SLIDE CAM UNIT

(75) Inventors: Ronny Gunnel, Hirschaid (DE); Norbert Nitz, Erlangen (DE); Arne Manteufel, Bamberg (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 14/116,188

(22) PCT Filed: Feb. 9, 2012

(86) PCT No.: PCT/EP2012/052178

§ 371 (c)(1),
(2), (4) Date: Nov. 7, 2013

(87) PCT Pub. No.: WO2012/152455

PCT Pub. Date: Nov. 15, 2012

(65) Prior Publication Data

US 2014/0076256 A1 Mar. 20, 2014

(30) Foreign Application Priority Data

May 10, 2011 (DE) ..... 10 2011 075 538

(51) Int. Cl.
*F01L 1/34* (2006.01)
*F01L 1/344* (2006.01)
*F01L 13/00* (2006.01)

(52) U.S. Cl.
CPC ..... *F01L 1/344* (2013.01); *F01L 13/0036* (2013.01)

(58) Field of Classification Search
CPC ..... F01L 13/0036; F01L 13/0042; F01L 2001/0473; F01L 2013/0052
USPC ..... 123/90.16, 90.44, 90.6, 90.18
See application file for complete search history.

(56) References Cited

U.S. PATENT DOCUMENTS

| | | | | |
|---|---|---|---|---|
| 8,161,930 | B2 * | 4/2012 | Elendt et al. | 123/90.6 |
| 8,584,639 | B2 * | 11/2013 | Elendt et al. | 123/90.18 |
| 2007/0178731 | A1 | 8/2007 | Elendt | |
| 2010/0108006 | A1 | 5/2010 | Elendt et al. | |
| 2010/0126448 | A1 | 5/2010 | Talan et al. | |
| 2011/0247577 | A1 | 10/2011 | Elendt et al. | |

FOREIGN PATENT DOCUMENTS

| | | |
|---|---|---|
| DE | 102004022849 | 12/2005 |
| DE | 202009015465 | 4/2010 |
| DE | 102008054254 | 5/2010 |
| EP | 0798451 | 10/1997 |
| WO | 2005080761 | 9/2005 |

* cited by examiner

*Primary Examiner* — Ching Chang
(74) *Attorney, Agent, or Firm* — Volpe and Koenig, P.C.

(57) ABSTRACT

A slide cam unit with a cam region is provided with an adjusting device having an actuator for adjusting the slide cam unit to different axial positions via slide grooves on the circumference of the slide cam unit. The adjusting device is arranged in a stationary manner and a device for fastening the slide cam unit in the different axial positions is provided. The cam region and the slide groove region of the slide cam unit are designed as separate cam and slide groove components which are fastened to each other with a positive-fit connection and fixed in place to each other by their support on the base shaft.

8 Claims, 9 Drawing Sheets

3
1
11
10
2
4
4
3

CONSTRUCTED SLIDE CAM UNIT

FIELD OF THE INVENTION

The invention relates to a reciprocating piston internal combustion engine with a crankcase in which at least one cylinder and one piston are arranged, with a cylinder head sealing the cylinder, the inlet and outlet channels thereof each being controlled by at least one gas exchange valve that is constructed as an intake or exhaust valve and can be actuated by cams of at least one camshaft and transmission elements driven by these cams, wherein the cams are constructed as sliding cams with at least one cam per sliding cam unit and these cams are arranged in a rotationally fixed but axially movable manner on a base shaft, wherein there is a device that has at least one extendable actuator pin and can be preferably electromagnetically actuated for each sliding cam unit for adjusting the sliding cam unit to different axial positions by means of slide grooves that interact with the actuator pin and are arranged on the periphery of the sliding cam unit, wherein the adjusting device is arranged in a stationary manner on a component of the internal combustion engine and wherein there is a device for fastening the sliding cam unit in the different axial positions.

BACKGROUND

A sliding cam unit for use in such a reciprocating piston internal combustion engine is known from EP 0 798 451 A1. This sliding cam unit is constructed as an integral component. It is therefore a very complicated part that also must be replaced as a whole unit if, e.g., one of the cams or one of the slide grooves requires repair.

SUMMARY

The objective of the invention is therefore to improve a sliding cam unit of a reciprocating piston internal combustion engine so that the described disadvantages are eliminated and so that it is also possible to adapt the individual assemblies of the sliding cam unit to the correspondingly required demands and loads. This should also involve economic production with simple means.

This objective of the invention is met in that the cam area and the slide groove area of the sliding cam unit are constructed as separate cam and slide groove components that can be fastened to each other.

It is possible to fasten the components to each other, e.g., by means of a weld connection. However, this can also lead to deformation or heat stresses, which are not desired in finished components, due to the local application of heat. It is especially important that the individual components can each be produced optimally in terms of manufacturing and then connected without great complexity, e.g., MIM components and forged parts or turned and milled parts.

In one advantageous refinement of the invention it is therefore proposed that the cam and slide groove components can be fastened to each other with a positive-fit connection. The cam and slide groove components are secured and fixed to each other in the end after their positive-fit connection by their support on the base shaft, i.e., the positive-fit connection does not have to be a three-dimensional fixing, it is sufficient if it guarantees an axial securing of the cam and slide groove components on each other, because the components are already supported on the base shaft and therefore the base shaft can take over the securing of the radial position. The positive-fit connection can have an arbitrary design, e.g., by grooves, wedges, snap-on connections, etc.

In another construction of the invention it is proposed that the cam and slide groove components have dovetail-shaped latching strips on the end faces that face each other. The latching strips are here tangential to the base shaft and parallel to and matching each other. The latching strips are here provided on at least one end face of the slide groove components and on at least one end face of a cam component and are constructed as a positive form on one component and as a negative form on the other component. This creates a latching of the components with each other, initiated by radial sliding of the components into the dovetail-shaped latching strips and the components also can be detached again through another radial sliding along the latching strips or in the opposite direction. The radial securing and final fixing is realized only after the sliding cam unit is placed on the base shaft.

If the sliding cam unit is made from one cam component and one slide groove component, then it can be preferable that the slide groove component has a radial support on the base shaft in the direction of the latching strips.

If a slide groove component and on both sides two cam components are used, then it is sufficient that the latching strips are rotated relative to each other on one side of the slide groove component relative to the other side by a greater angular magnitude, e.g., 90 degrees, wherein a complete radial support of the slide groove component is realized by means of the two cam components.

In one alternative construction of the invention it is proposed that the cam and slide groove components can be fastened to each other according to the latch/eyelet principle.

For this purpose, the cam or slide groove components have, on their inner periphery close to their end faces, slots that extend around part of the periphery, wherein the counterpart, namely the slide groove or cam component, has flange-shaped latching elements that are allocated to the slots and enclose the same part of the periphery as the slots. In this construction, the components are connected to each other by means of the latching elements and slots and oriented so that the end faces contact each other. By placing such a sliding cam unit on the base shaft, the final securing is then also realized. In this construction, there can be matching surfaces that are allocated to the components and cause a radial support of the slide groove component relative to the base shaft or the cam component supported on the base shaft.

It is further proposed that the device for securing the sliding cam unit in the different axial positions is realized such that locking grooves are provided on the inner periphery of the slide groove components, wherein these locking grooves are in active connection with spring-loaded locking bodies supported in the base shaft. The production of such locking grooves is considerably simplified, because the access to the inner periphery of the slide groove component is easier than in an integral sliding cam unit.

On the periphery of the slide groove components there are slide grooves that are oriented in opposite directions and approach each other in the axial direction so that they intersect each other. They are machined to different radial depths and are in active connection with an adjusting device that has two actuator pins arranged next to each other. With such a slide groove component and such an adjusting device it is possible to arrange three cams on a cam component and to slide the cam component such that each of the three cams can be in active connection individually with the transmission element so that the gas exchange valve or the gas exchange valves can have different strokes and/or different angular positions on the camshaft. It is expressly noted that the invention is not restricted to the described groove shapes and groove constructions. Other known groove shapes, e.g., S-grooves or double S-grooves, etc., arranged one after the other could also be provided.

BRIEF DESCRIPTION OF THE DRAWINGS

For further explanation of the invention, refer to the drawings in which two embodiments of the invention are shown simplified. Shown are.

DETAILED DESCRIPTION OF THE PREFERRED EMBODIMENTS

In FIGS. 1 to 9, as far as shown in detail, 1 designates a sliding cam unit that has a slide groove component 2 and two cam components 3. The cam components 3 each have three cams that have different cam strokes and different cam positions relative to each other.

Figure 1:
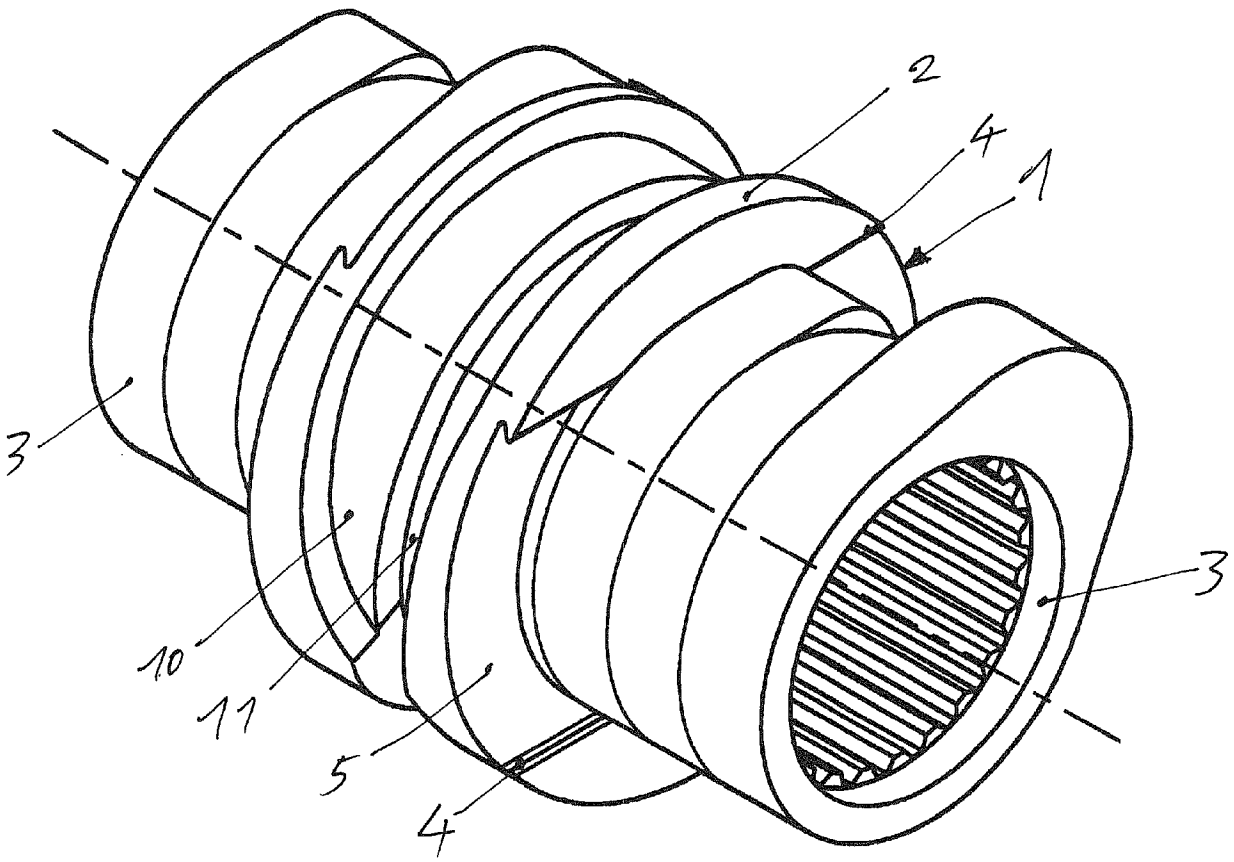
FIGS. 1 to 4: a positive-fit connection of the components to each other according to embodiment 1 with a perspective view of the sliding cam unit, a section through this unit, a perspective view of a slide groove component, and a cam component.
Figure 2:
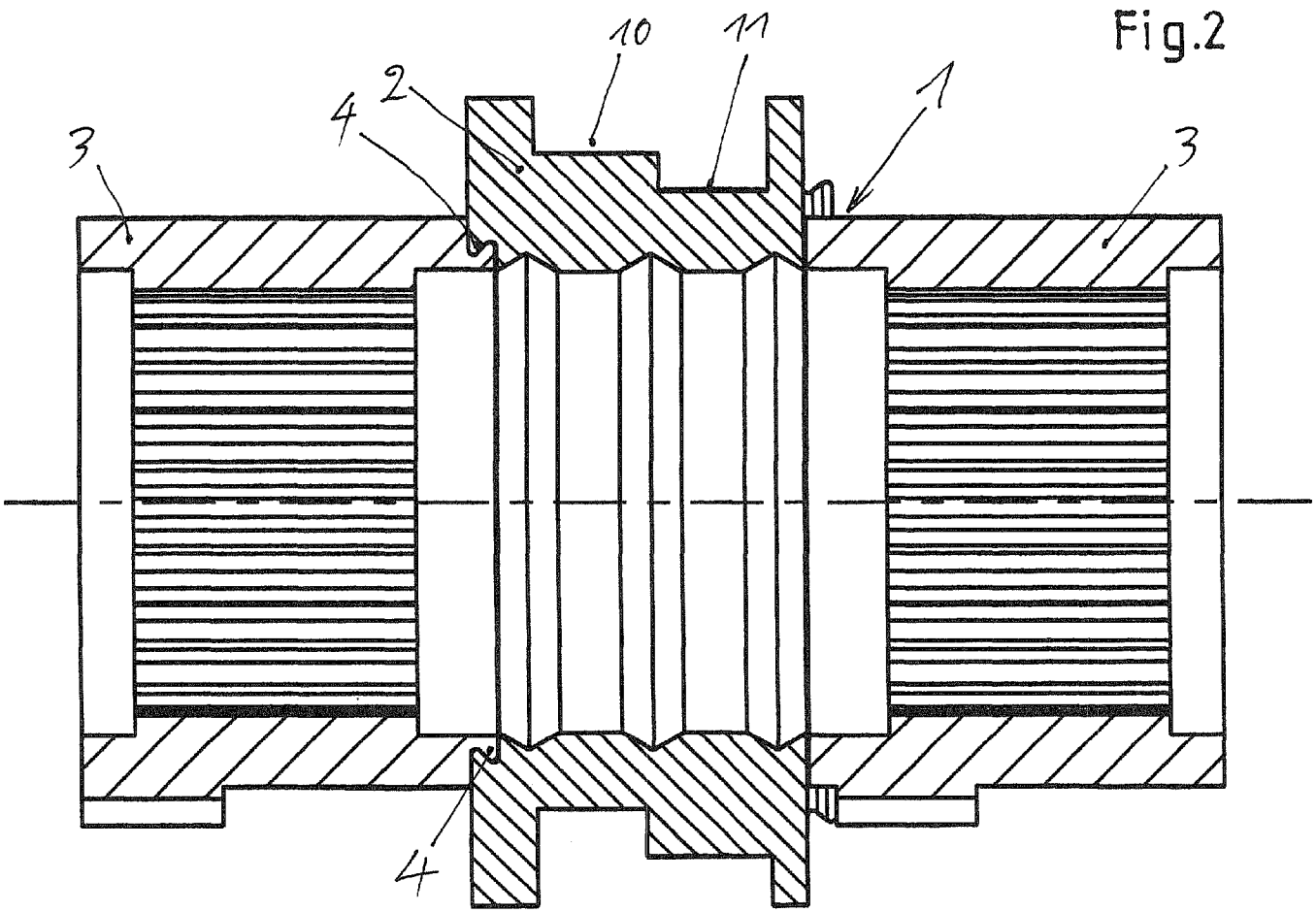
Figure 3:
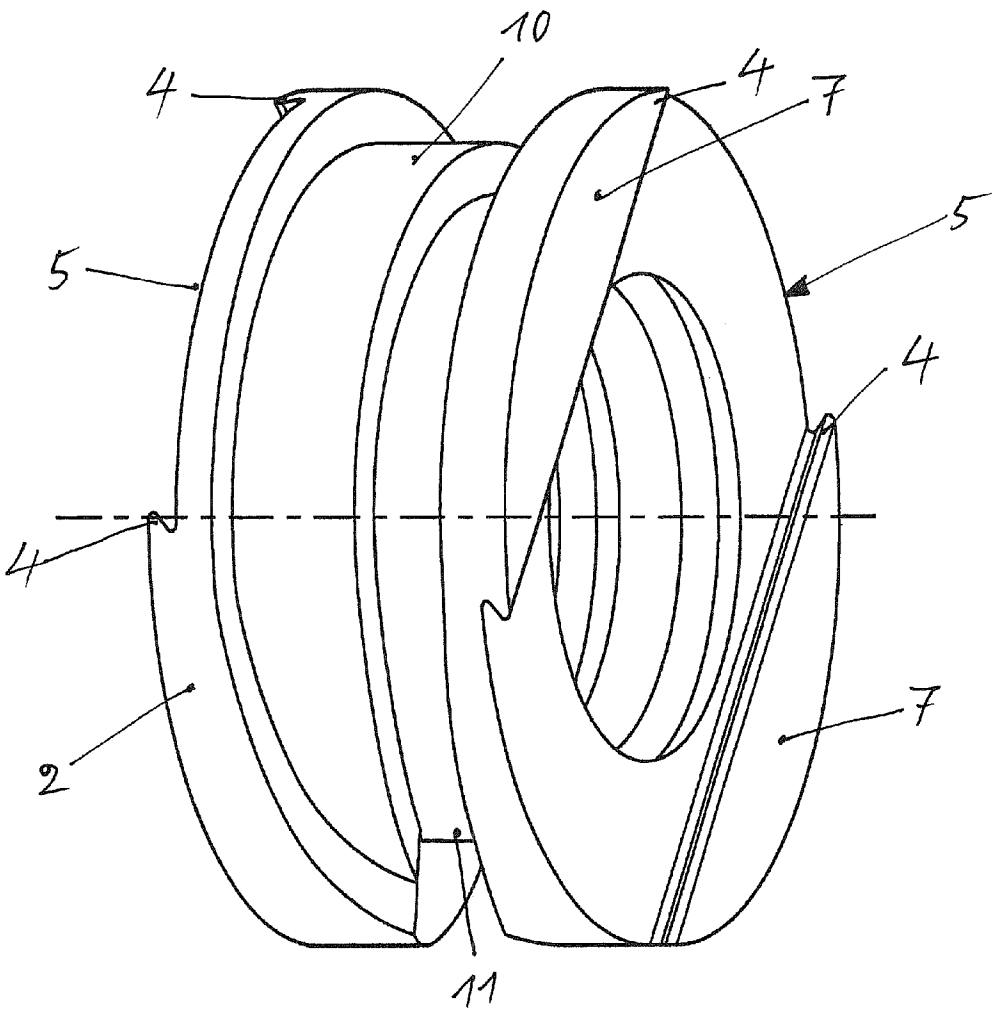
Figure 4:
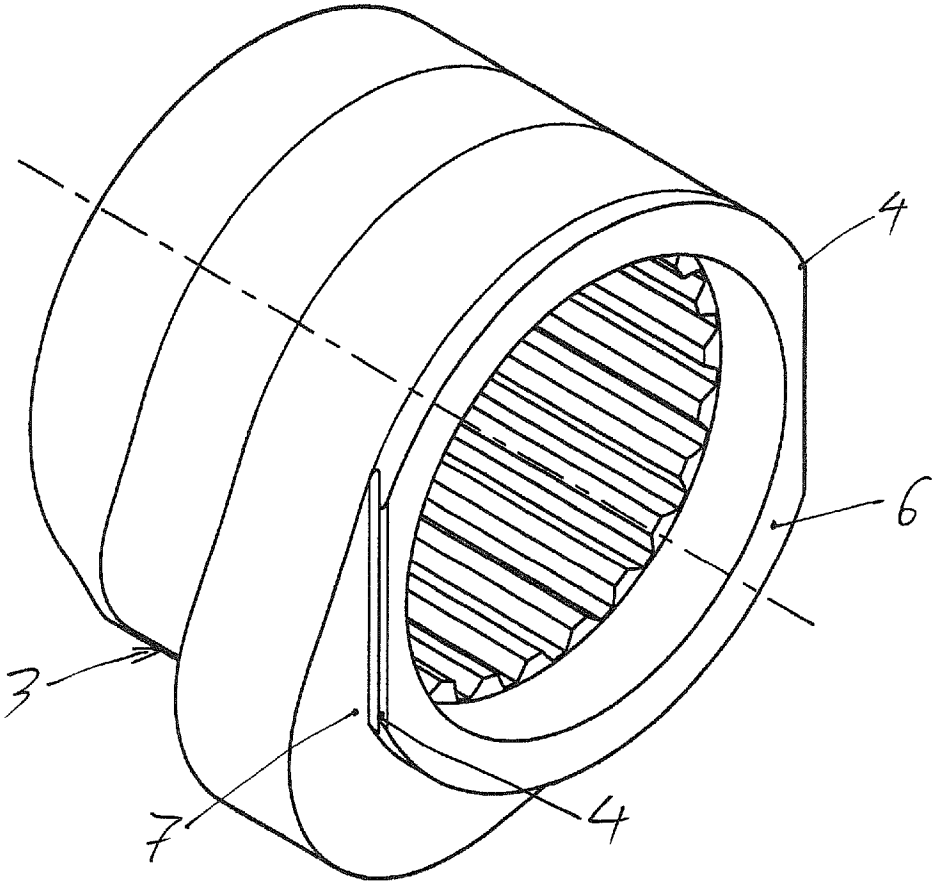
Figure 5:
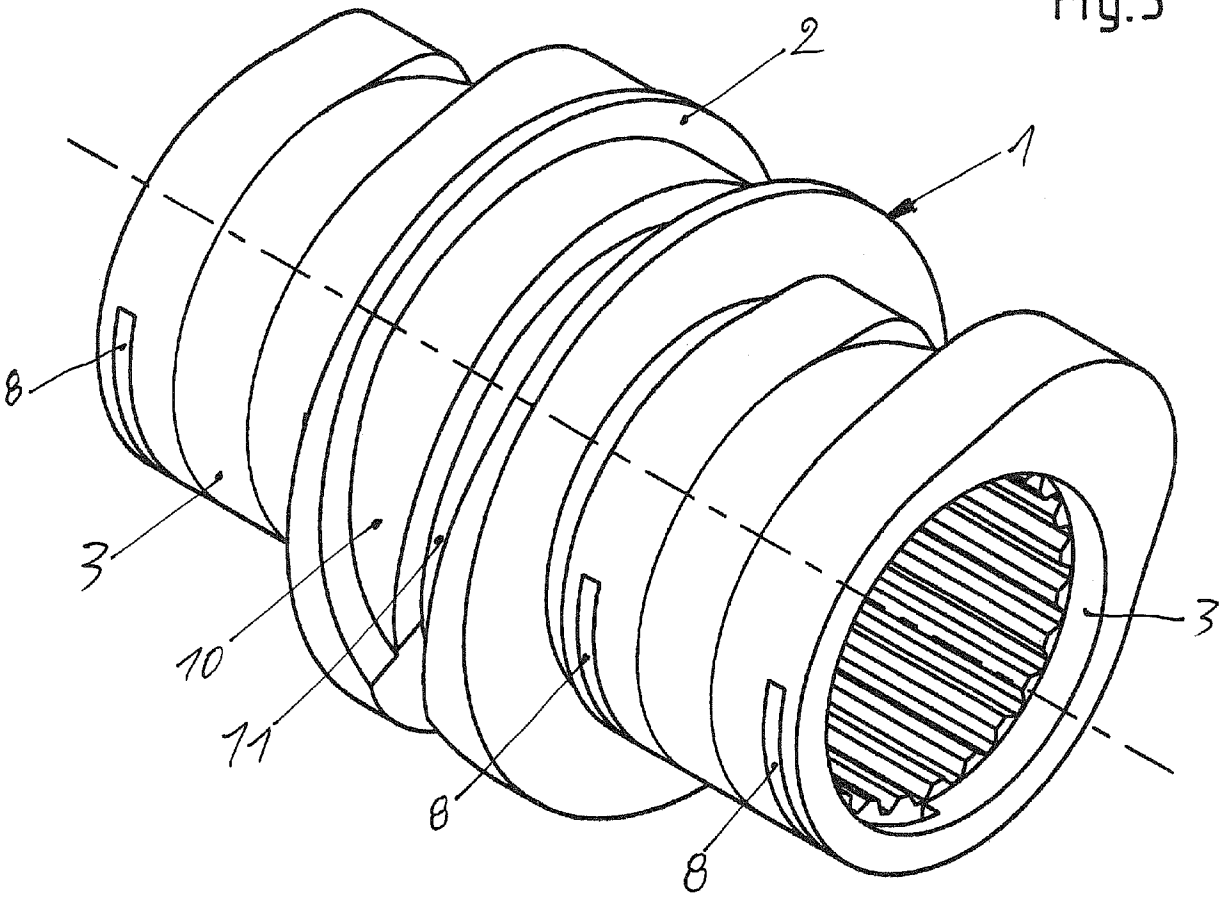
FIGS. 5 to 8: a positive-fit connection according to embodiment 2 with views corresponding to FIGS. 1 to 4, and FIG. 9 a side view of a slide groove component according to version 2.
Figure 6:
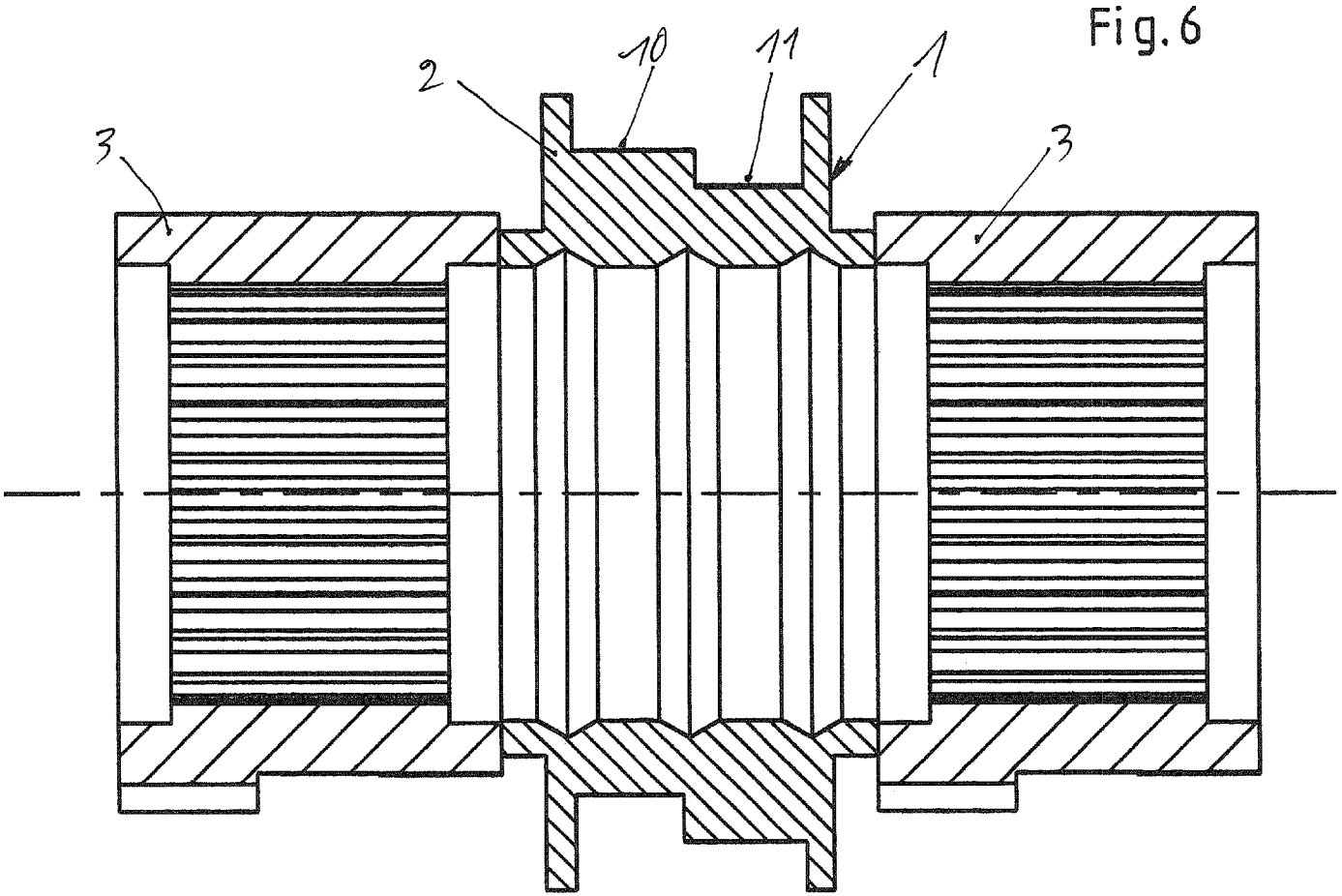
Figure 7:
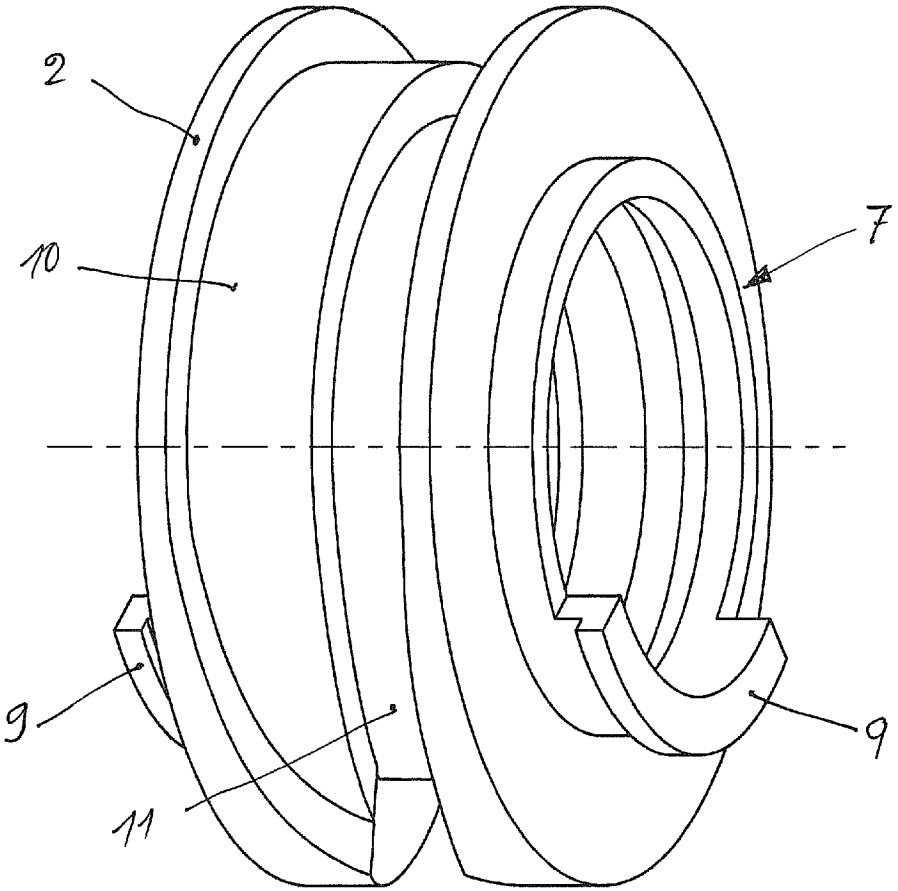
Figure 8:
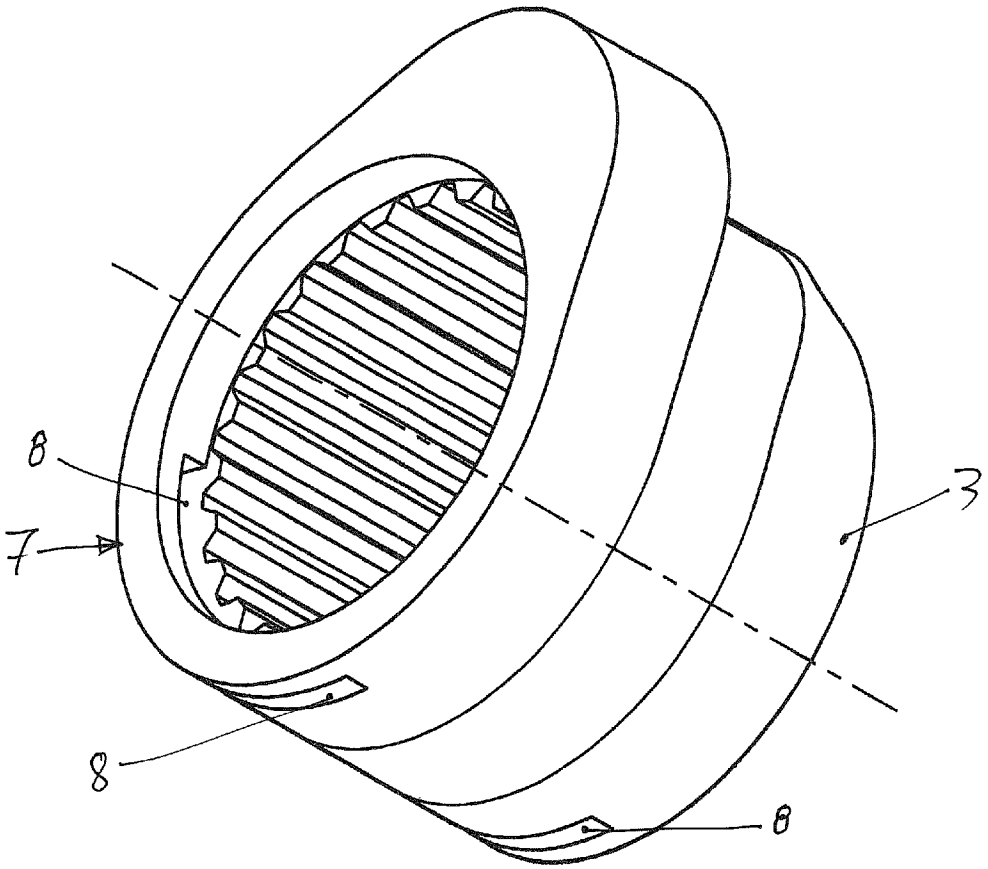

The positive-fit connection of the slide groove component 2 and the cam components 3 is realized according to FIGS. 1 to 4 by means of dovetail-shaped latching strips 4 that are machined tangential to the axis of the sliding cam unit 1 on end faces designated with 7, as can be seen, in particular, in FIGS. 3 and 4. They are constructed parallel to each other and matching so that on the two sides of the slide groove component 2 there is a negative form 5 and on one side of the cam components 3 there is a positive form 6. The cam components 3 therefore can be connected to the slide groove component 2 by radial sliding and latching in the latching strips 4, wherein the final securing of the components to each other is realized by placing the sliding cam unit 1 on a not-shown base shaft.

In order to allow clearance within the slide groove component 2 (see FIG. 2), the latching strips 4 are rotated on one side of the slide groove component 2 relative to the other side by 90 degrees (FIGS. 1 and 3), so that the slide groove component 2 is supported in the radial direction on the cam components 3.

In the embodiment according to FIGS. 5 to 8, the cam components 3 have, at a distance to the end faces 7, slots 8 that are constructed continuous and provided only over a peripheral area that lies in the reference circle of the cam. The slide groove component 2 has latching elements 9 that match the component and extend on part of the periphery such that they can be introduced into the slots 8 of the cam components 3 in a matching way during the latching process. After inserting the latching elements 9 into the slots 8, the cam components 3 are oriented relative to the slide groove component 2 so that they can be pushed onto the not-shown base shaft and in this way a final securing is realized.

Figure 9:
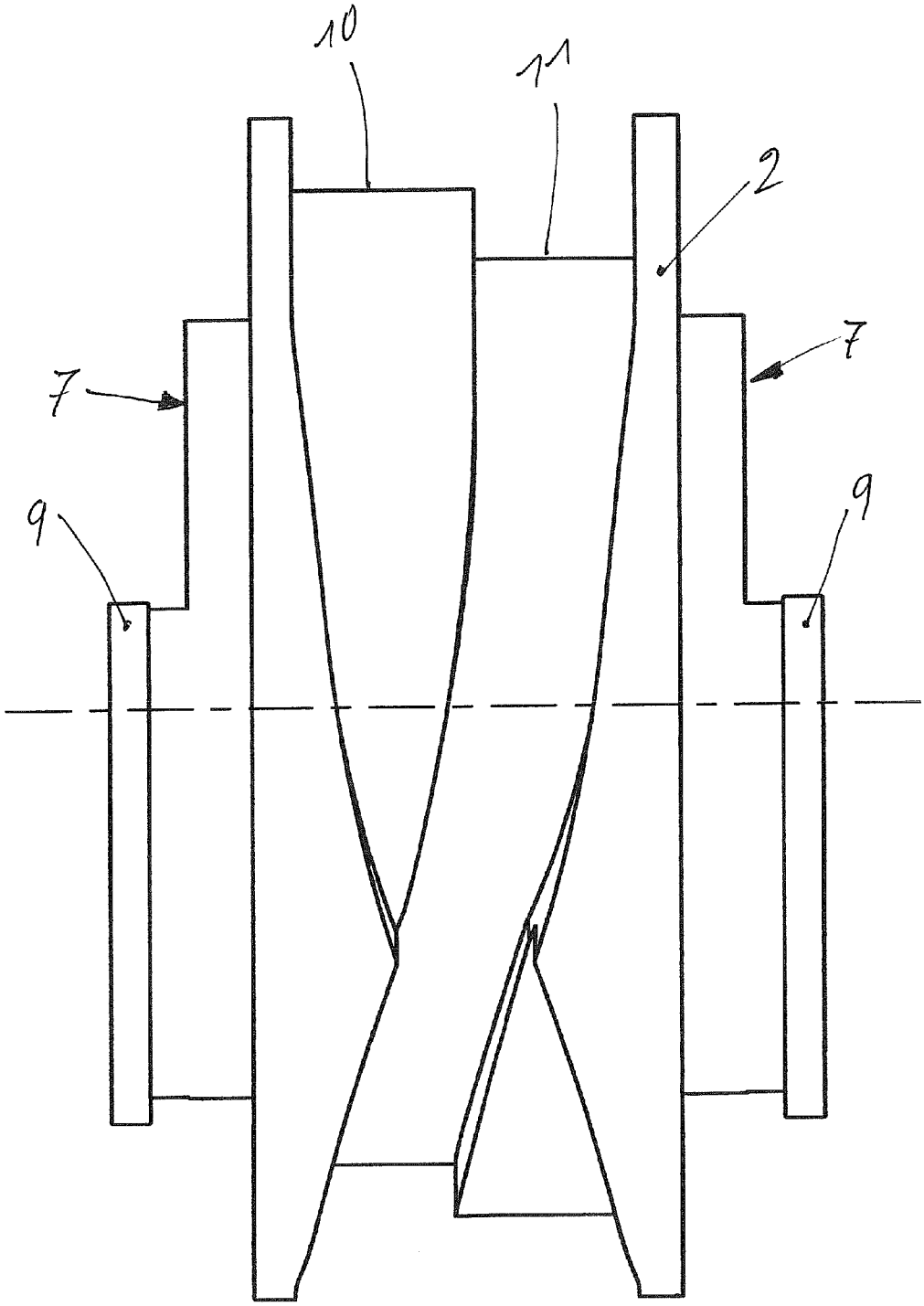

In the side view of the slide groove component 2 according to FIG. 9 there are slide grooves that are in addition to the latching elements 9 and are designated with 10 and 11 and are machined to different radial depths and are arranged so close to each other that they intersect each other so that three axial positions matching the three cams can be realized with an adjusting device with two actuator pins arranged next to each other and the slide grooves 10 and 11.

LIST OF REFERENCE SYMBOLS

1 Sliding cam unit
2 Slide groove component
3 Cam components
4 Latching strips
5 Negative form
6 Positive form
7 End faces
8 Slot
9 Latching elements
10 Slide groove
11 Slide groove

The invention claimed is:

1. A reciprocating piston internal combustion engine comprising a crankcase in which at least one cylinder and one piston are arranged, with a cylinder head sealing the cylinder, inlet and outlet channels thereof each being controlled by at least one gas exchange valve that is constructed as an intake or exhaust valve and are actuatable by cams of at least one camshaft and transmission elements driven by the cams, the cams are constructed as sliding cam units with at least one cam per sliding cam unit and the cams are arranged in a rotationally fixed but axially movable manner on a base shaft, an adjustable device that has at least one extendable actuator pin that is actuatable for each of the sliding cam units for adjusting the respective ones of the sliding cam unit to different axial positions by slide grooves that interact with the actuator pin that are arranged on a periphery of the sliding cam unit, the adjusting device is arranged in a stationary manner on a component of the internal combustion engine and a device for fastening the sliding cam unit in different axial positions, and a cam area and a slide groove area of the sliding cam unit are constructed as separate cam and slide groove components that are fastenable to each other with a positive-fit connection and fixed in place to each other by their support on the base shaft after the positive-fit connection.

2. The Reciprocating piston internal combustion engine according to claim 1, wherein the separate cam component and the separate slide groove component have dovetail-shaped latching strips on end faces thereof facing each other.

3. The Reciprocating piston internal combustion engine according to claim 2, wherein the latching strips are constructed tangential to the base shaft and parallel to and fitting in each other.

4. The Reciprocating piston internal combustion engine according to claim 2, wherein the latching strips are constructed on one side as a positive form and on the other side as a negative form on at least one of the end faces of the slide groove components and the cam components.

5. The Reciprocating piston internal combustion engine according to claim 1, wherein the separate cam component and the separate slide groove component are fastened to each other by a latch/eyelet connection.

6. The Reciprocating piston internal combustion engine according to claim 5, wherein the separate cam component and the separate slide groove component have slots that extend around part of a periphery on an inner periphery of thereof and there are flange-shaped latching elements that are allocated to the slots on the other of the slide groove or the cam components and enclose part of the periphery matching the slots.

7. The Reciprocating piston internal combustion engine according to claim 1, wherein locking grooves that are in active connection with spring-loaded locking bodies supported in the base shaft are provided for fixing the sliding cam unit in the different axial positions on an inner periphery of the slide groove components.

8. The Reciprocating piston internal combustion engine according to claim 1, wherein two slide grooves that are oriented in opposite directions and intersect with each other and are machined to different radial depths are provided on a periphery of the slide groove components and the adjusting device have two of the actuator pins arranged next to each other.

* * * * *